United States Patent [19]

Benedict

[11] Patent Number: 5,040,782

[45] Date of Patent: Aug. 20, 1991

[54] SORTING APPARATUS

[75] Inventor: Lawrence R. Benedict, Marion, N.Y.

[73] Assignee: Xerox Corporation, Stamford, Conn.

[21] Appl. No.: 116,178

[22] Filed: Nov. 3, 1987

[51] Int. Cl.[5] ..... B65H 39/10

[52] U.S. Cl. ..... 271/294; 270/58

[58] Field of Search ..... 270/58; 271/3, 3.1, 271/162, 157, 158, 292, 294, 9

[56] References Cited

U.S. PATENT DOCUMENTS

| | | | |
|---|---|---|---|
| 2,298,215 | 10/1942 | Kinker | 74/84 |
| 3,421,380 | 1/1969 | Mansour | 74/84 |
| 3,827,312 | 8/1974 | Bristol et al. | 74/36 |
| 4,083,550 | 4/1978 | Pal | 270/58 |
| 4,146,216 | 3/1979 | Brown | 270/58 |
| 4,157,822 | 6/1979 | Miller | 271/3.1 |
| 4,322,069 | 3/1982 | Mitchell | 271/292 |

*Primary Examiner*—H. Grant Skaggs

*Attorney, Agent, or Firm*—H. Fleischer; J. E. Beck; R. Zibelli

[57] ABSTRACT

An apparatus in which copy sheets are sorted into sets of copy sheets and positioned at a discharge region by trays mounted slidably on a frame in the finishing station of an electophotographic printing machine. Each tray has an entrance region and an exit region Copy sheets are received at the entrance region of the trays. Successive trays are moved to the set discharge region where completed sets of copy sheets are removed from the exit regions thereof.

6 Claims, 5 Drawing Sheets

SORTING APPARATUS

This invention relates generally to an apparatus for sorting sheets, and more particularly concerns a sorting apparatus used in a finishing station of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are then sorted and collected into sets of copy sheets. The copy sheets of each set are then secured to one another and stacked for presentation to the machine operator.

In a high speed commercial printing machine of the foregoing type, the sets of copy sheets are frequently stapled or adhesively bound together. In order to successfully staple or adhesively bind the sheets to one another, the copy sheets must be sorted into sets. This may be achieved by using a sorting apparatus. Generally, the sorting apparatus has a plurality of bins or trays wherein each tray is designed to collect one set of copy sheets. A variety of sorters are known in the art. One type of sorter employs trays which are spaced apart and extend in a linear row. Another type of sorting apparatus has trays extending radially outwardly from an axis of rotation. These are the two basic types of sorters generally used commercially, i.e. a linear type and a rotary type. Various mechanisms are employed to move the sorter trays past a sheet inlet region where the copy sheets are received on successive trays. In this manner, identical copy sheets are advanced to different sorter trays to form identical sets of copy sheets on each tray. After a complete set of copy sheets is compiled on a sorter tray, the set of copy sheets is advanced to either a stapler or adhesive binder.

Various approaches have been devised for indexing sorter trays. The following disclosures appear to be relevant:

U.S. Pat. No. 2,298,215: Patentee: Kinker: Issued: Oct. 6, 1942.

U.S. Pat. No. 3,421,380: Patentee: Mansour: Issued: Jan. 14, 1969.

U.S. Pat. No. 3,827,312: Patentee: Bristol et al.: Issued: Aug. 6, 1974.

The relevant portions of the foregoing patents may be summarized as follows:

U.S. Pat. No. 2,298,215 discloses a periodic motion mechanism using a composite cam which imparts periodic movement by two series of cam rollers carried by a table. The table is indexed every 60° of its rotation.

U.S. Pat. No. 3,421,380 describes an intermittent motion apparatus having four rollers which engage an arcuate surface of a disc. Springs bias the driven member in a rotational direction corresponding to the direction of rotation imparted to the driven member by the driving member.

U.S. Pat. No. 3,827,312 discloses an indexing mechanism for a collating and collecting apparatus using an indexing plate having cam followers which are driven by drive rollers. The indexing drive includes a reversible drive motor having a pulley attached to its shaft for driving a drive belt connected to a drive pulley coaxially mounted on a drive rotor.

In accordance with one aspect of the present invention, there is provided an apparatus for sorting sheets into sets of sheets and positioning the sets of sheets at a discharge region. The apparatus includes a frame having a plurality of trays mounted slidably thereon. The trays are fixed relative to one another with each tray having an entrance region for receiving sheets and an exit region opposed therefrom. Means are provided for moving successive trays to the set discharge region so as to remove successive sets of copy sheets from the exit regions of the trays.

Pursuant to another aspect of the features of the present invention, there is provided a printing system including means for reproducing copies of original documents on copy sheets. Means, positioned to receive the copy sheets from the reproducing means, sort the sheets into sets of sheets and position the sets of sheets at a set discharge region. The sorting means includes a frame having a plurality of trays mounted slidably thereon. The trays are fixed relative to one another with each tray having an entrance region for receiving sheets and an exit region opposed therefrom. Means are provided for moving successive trays to the set discharge region so as to remove successive sets of copy sheets from the exit regions of said trays.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
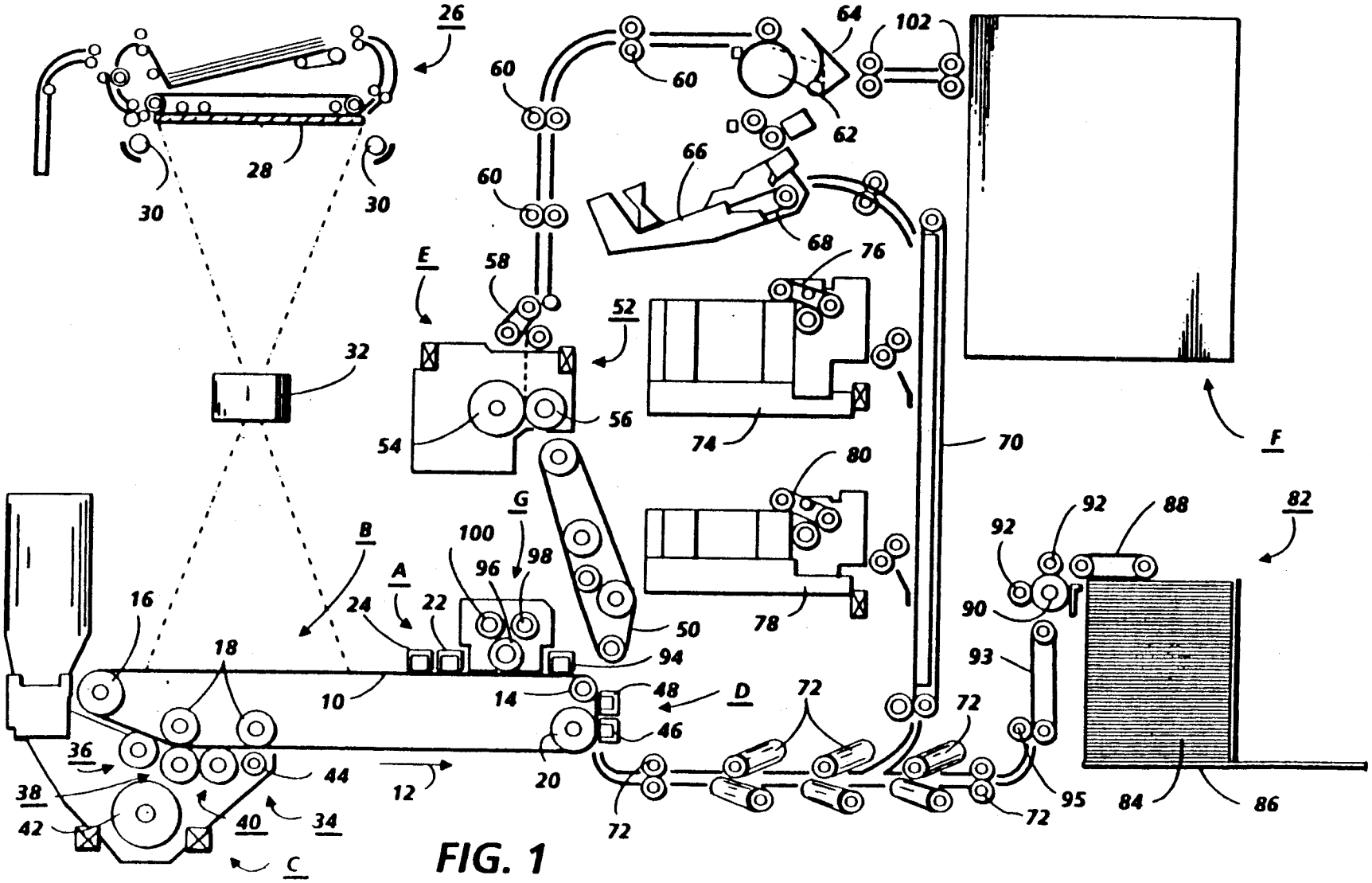
FIG. 1 is a schematic elevational view depicting an illustrative electrophotographic printing machine incorporating the sheet sorting apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet sorting apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a grounding layer, which, in turn, is coated on a anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. The details of finishing station F will be described hereinafter with reference to FIG. 2. Duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaning brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner paricles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
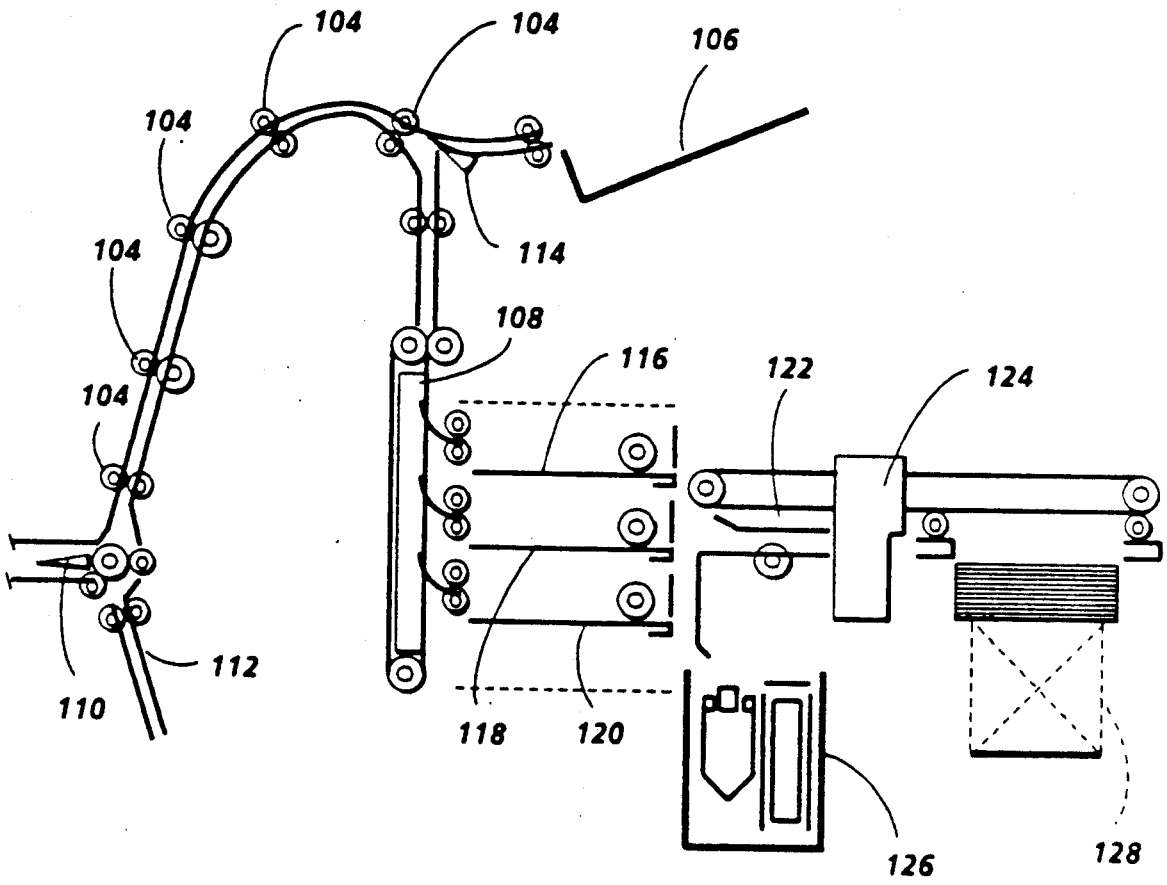
FIG. 2 is a schematic elevational view showing the finishing station of the FIG. 1 printing machine with the sheet sorting apparatus.

Referring now to FIG. 2, the general operation of finishing station F will now be described. Finishing station F receives fused copies from rolls 102 (FIG. 1) and delivers them to solenoid actuated gate 110. Gate 110 diverts the copy sheet to either registration rolls 104 or inverter 112. A tri-roll nip is used to drive sheets into and out of the inverter. Inverter 112 has a compression spring which assists in reversing the direction of the sheets and assists in driving them out of the inverter. Inverter 112 is driven by a reversible AC motor. Two cross roll registration nips are used to register the sheets. The cross roll registration nips are driven by the sheet path drive motor. Rolls 104 advance the copy sheets to gate 114. Gate 114 diverts the sheets to either the top tray 106 or to vertical transport 108. Vertical transport 108 is a vacuum transport which transports sheets to a sorting apparatus, indicated generally by the reference numeral 115. Sorting apparatus 115 has three trays 116, 118 or 120. The copy sheets are advanced to any one of the three trays 116, 118 or 120. Trays 116, 118, and 120 are used to sort and register the copy sheets into sets of copy sheets. The trays are driven up or down by a bidirectional AC drive motor adapted to position one of the trays at a discharge region 117 when a complete set of copy sheets is disposed therein. Further details of sorting apparatus 115 will be described hereinafter with reference to FIGS. 3 through 7, inclusive. After a tray is positioned at discharge region 117 with a complete set of copy sheets, a set transport 122, having a pair of set clamps mounted on two air cylinders and driven by four air valve solenoids, removes the set of copy sheets from the tray. Two of the air valves are used for positioning the set transport and two are used for the retract function. The set transport is used to transport sets from sorting apparatus 115 to sheet stapling apparatus 124, binder 126 and sheet stacker 128. The stapled, bound, or unfinished sets are delivered to stacker 128 where they are stacked for delivery to the operator.

Figure 3:
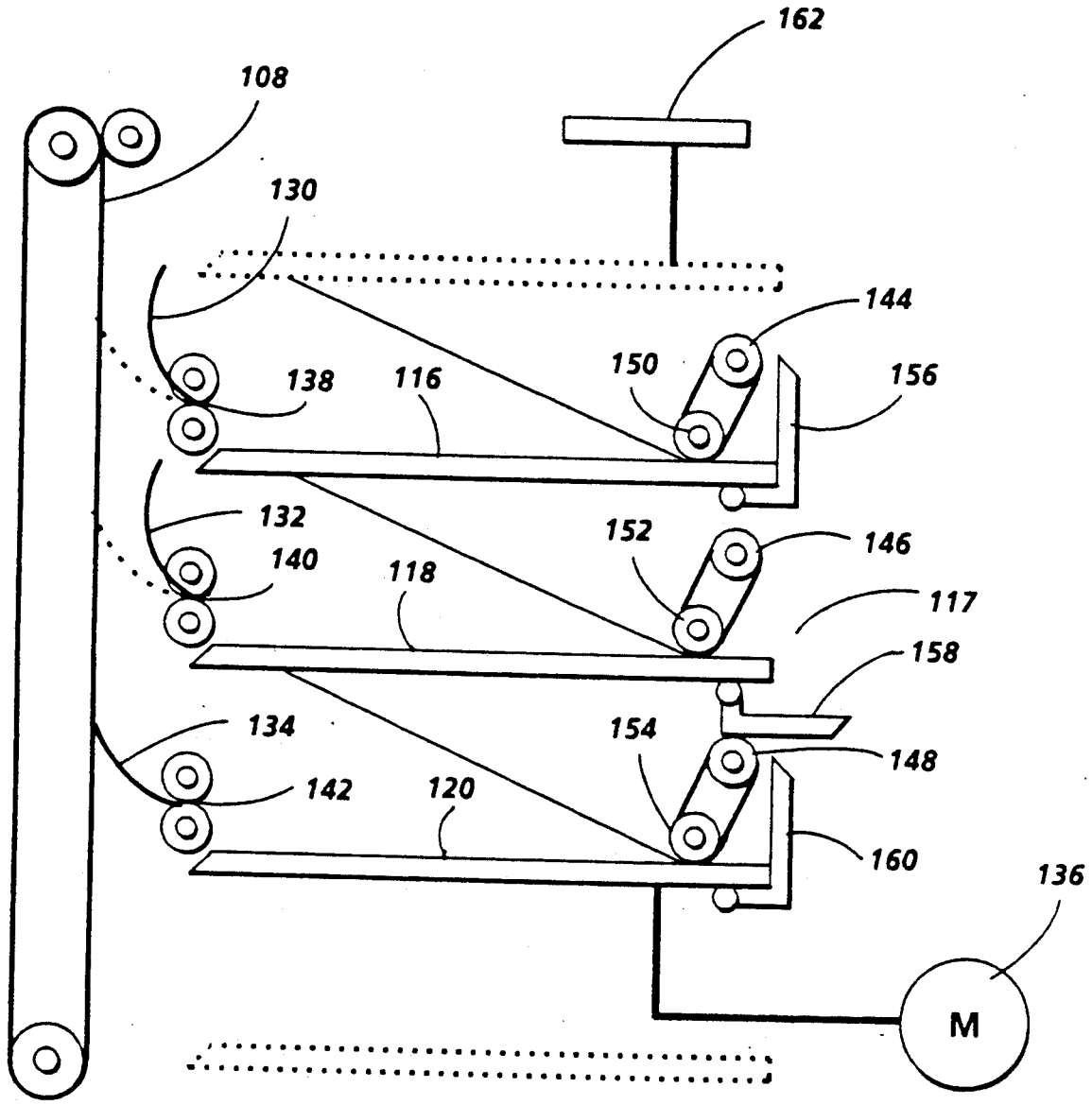
FIG. 3 is a schematic elevational view further illustrating the FIG. 2 sorting apparatus.

Turning now to FIG. 3, vertical transport 108 receives the copy sheet and delivers it to a position where the copy sheet is stripped from the vertical transport 108 and delivered to one of the trays of sorter 115. Entrance baffles guide the copy sheet onto vertical transport 108. Vertical transport 108 has five spaced vacuum belts. The belts are positioned between grooves in the face of the transport. Copy sheets are held on the belts by a vacuum produced by a vacuum blower. Solenoid actuated stripper fingers 130, 132 and 134 are opposed from the grooves in the transport. In this way, selected stripper fingers are moved into the grooves to deflect the copy sheet onto the selected tray. The grooves allow the stripper fingers to be positioned below the surface of the copy sheet and strip the copy sheet from transport 108 and direct it to the appropriate tray of sorter 115.

With continued reference to FIG. 3, sorting apparatus 115 operates in conjunction with vertical transport 108 to produce sets of copy sheets. Sorting apparatus 115 has three trays 16, 118, and 120 that are used to compile and register copy sheets into sets of copy sheets. The trays are driven up and down by the bidirectional AC drive motor 136 in association with the indexing mechanism. The indexing mechanism is employed to insure accurate positioning of the trays. The trays of the sorting apparatus are mounted slidably on rods or shafts 164 and 166 (FIG. 4) secured to the frame of the finisher. The detailed structure of the indexing mechanism will be described hereinafter with reference to FIGS. 4 through 7, inclusive. Each stripper finger is a solenoid actuated finger used to divert copy sheets from vertical transport 108 into the proper tray. Stripper finger 134, the stripper finger associated with the lowermost tray 120, is mechanically held in the open position and does not require a solenoid. There are three pairs of corrugation rollers 138, 140 and 142 positioned at the entrance to trays 116, 118 and 120, respectively. The pairs of rollers are driven by a drive motor through a drive release clutch and are used to drive copy sheets through the nip therebetween into the trays. Scuffer clutches 144, 146, and 148, located at the right rear of trays 116, 118, and 120, respectively, drive scuffer rolls 150, 152, and 154, respectively, in order to corner register each copy sheet entering the tray against registration gates 156, 158, 160, respectively. The entrance and exit regions of the trays are opposed from one another. Thus, the copy sheet enters the tray on one side thereof and exits the trays on the other side opposed from the entrance side. When a tray contains a complete set of copy sheets, it is indexed to discharge region 117. Tray 118 is shown at discharge region 117. When the tray is at the discharge region with a complete set of copy sheets, an air cylinder is actuated to open the registration gate. Registration gate 158 is shown in the open position. Then, set transport 122 (FIG. 2) advances the set of copy sheets from tray 118 to either stapler 124 (FIG. 2) or binder 126 (FIG. 2).

Figure 4:
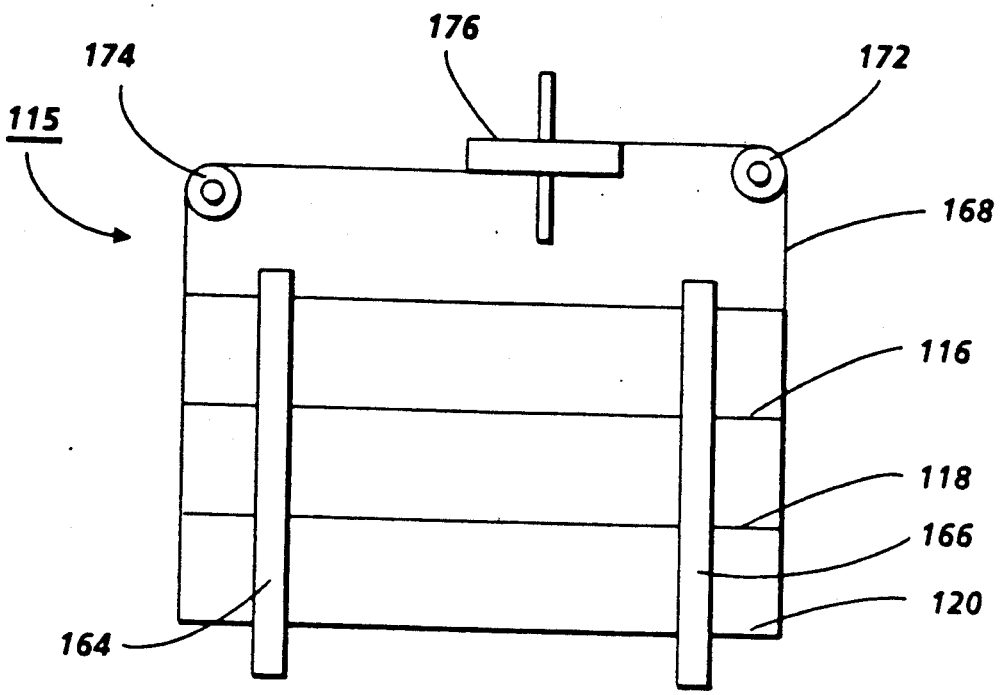
FIG. 4 is a schematic, elevational view of the trays and indexing mechanism of the FIG. 3 sorting apparatus.
Figure 5:
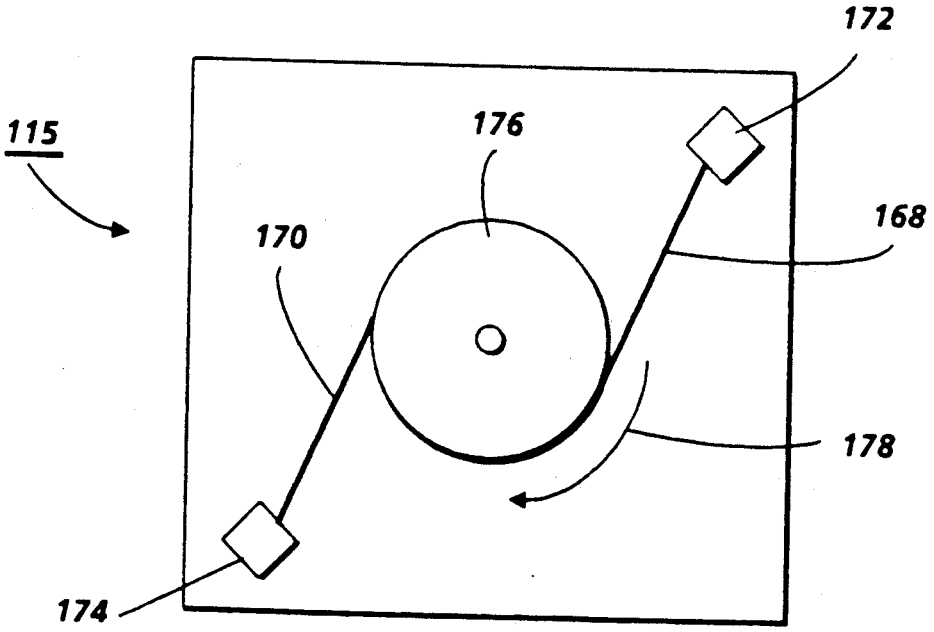
FIG. 5 is a schematic plan view of the trays and indexing mechanism of the FIG. 3 sorting apparatus.

Turning now to FIG. 4, trays 116, 118, and 120 of sorter 115 are mounted slidably on two vertical shafts 164 and 166, mounted on opposite corners of the finisher frame, which allow the trays to slide up and down. The trays are suspended by two cables 168 and 170 which attach to the trays in the other corners. Cables 168 and 170 pass over and around idler pulleys 172 and 174 and are attached to pulley 176. The trays are fixed relative to one another and move in unison. When pulley 176 is rotated in one direction, the trays move in an upward direction. When pulley 176 is rotated in the opposite direction, the trays will move in a downward direction. As shown in FIG. 5, when pulley 176 is rotated in the direction of arrow 178, the trays will move in an upwardly direction. The trays move in a downwardly direction when pulley 176 is rotated in a direction opposite to the direction of arrow 178.

Figure 6:
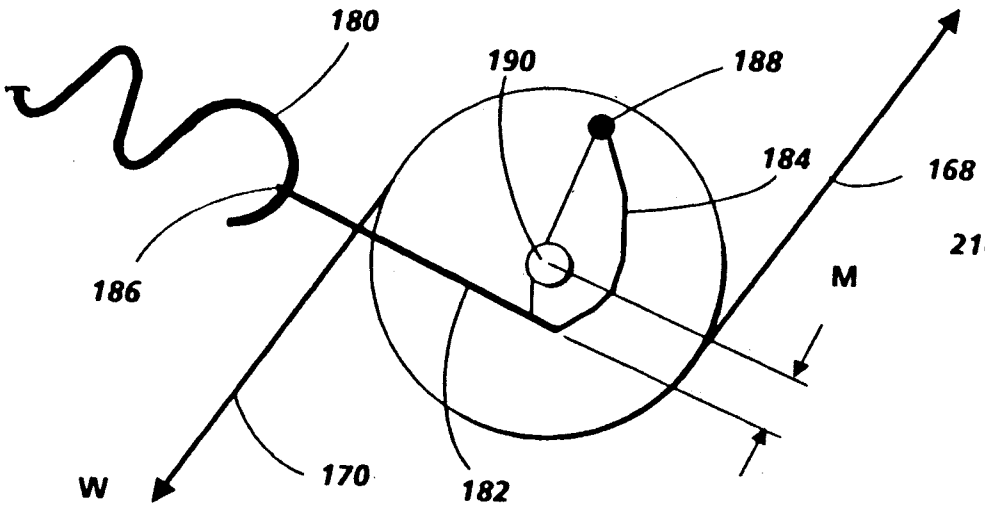
FIG. 6 is a plan view of the counterbalance mechanism used in the FIG. 3 sorting apparatus.

As shown in FIG. 6, the weight of the trays is counterbalanced by an extension spring 180. The torque applied on the pulley by spring 180 is maintained constant as the spring length varies due to the movement of the trays. Spring 180 has one end thereof connected to pulley 176 by a cable 182 through a spring cam 184. This end is also secured to the shaft 190 supporting pulley 176 rotatably. The spring is attached to the free end 186 of cable 182. The other end of the cable is attached to a pin 188 secured fixedly to pulley 176. Spring cam 184 is designed such that the greater the extension of spring 180, the shorter the moment arm, M, between cable 182 and shaft 190. As the spring 180 becomes longer, the moment arm M becomes smaller so as to maintain a constant torque on pulley 176 to offset the weight of the trays. In this way, a constant torque is maintained on pulley 176 which is opposite and equal to the torque applied on the pulley by the weight of the trays.

Figure 7:
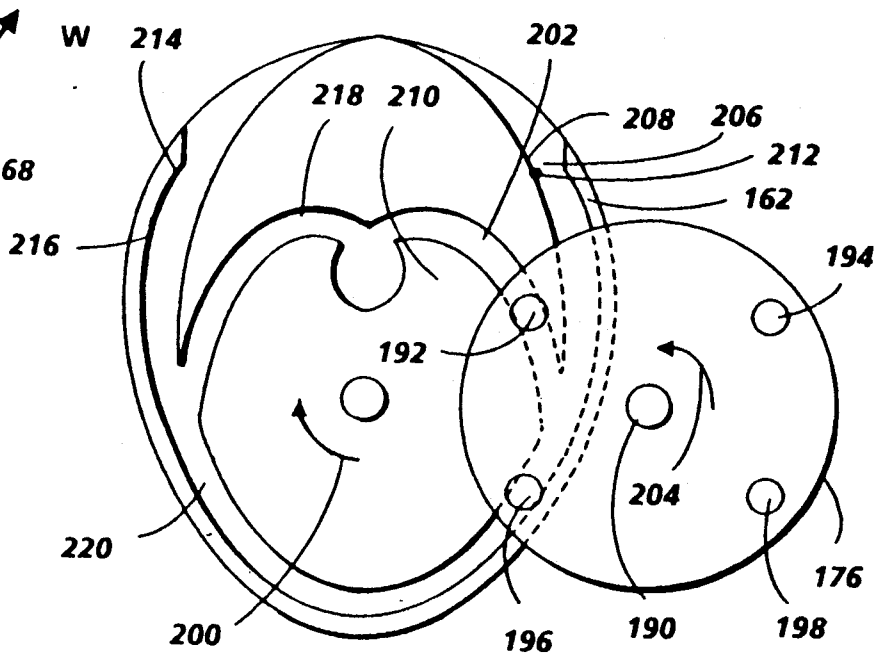
FIG. 7 is plan view of the cam and follower used in the indexing mechanism of the FIG. 3 sorting apparatus.

Referring now to FIG. 7, the details of the indexing mechanism for the movement of the trays will be described in greater detail. Attached to pulley 176 are four cam followers 192, 194, 196, and 198. Cam followers 192, 194, 196, and 198 are located equidistant from the center of shaft 190 and from one another. The cam followers are driven by cam 162. Cam 162 is driven by a belt driven by motor 136 (FIG. 3). Grooves are cut in the surface of cam 162 for controlling the movement of the cam followers. The grooves in cam 162 drive the followers through 90° of rotation for 180° of rotation of cam 162. The cam also has 180° of dwell which locks the trays in a fixed location and provides sufficient coast angle for the motor to stop. When cam 162 is rotated in the direction of arrow 200, cam follower 192 will follow groove 202. This rotates pulley 176 slightly in the direction of arrow 204 which, in turn, causes cam follower 196 to follow groove 206. Surface 208 of groove 206 presses against follower 196 causing pulley 176 to further rotate in the direction of arrow 204. This further rotation causes cam follower 192 to contact surface 210. The contact between surface 210 and follower 192 further rotates pulley 176 in the direction of arrow 204. This continued rotation of pulley 176 in the direction of arrow 204 causes cam follower 196 to leave cam 162 at point 212, and cam follower 194 to enter the cam at point 214. Contact between surface 216 and cam follower 194 further rotates pulley 176 in the direction of arrow 204. As pulley 176 continues to rotate in the direction of arrow 204, cam follower 192 enters groove 218. With continued rotation of pulley 176, in the direction of arrow 204, cam followers 192 and 194 are positioned in groove 220. This locks pulley 176 in the new position for the next 180° of rotation of cam 162.

In recapitulation, the sheet sorting apparatus of the present invention includes a plurality of slidably mounted trays which receive successive copy sheets at entrance regions thereof and discharge sets of trays from the exit regions thereof. The trays are fixed relative to one another and move in unison. Successive trays move to a discharge region where compiled set of copy sheets are discharged from the trays.

It is, therefore, evident that there has been provided, in accordance with the present invention, a sheet sorting apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for sorting sheets into sets of sheets and positioning the sets of sheets at a set discharge region, including:

at least one vertically oriented rod;

a plurality of trays mounted slidably on said rod, said trays being fixed relative to one another with each one of said trays having an entrance region for receiving sheets and an exit region opposed therefrom; and means for moving successive ones of said trays to the set discharge region so as to remove successive sets of copy sheets from the exit region of said trays, said moving means comprising a pulley, at least one flexible member having one end portion thereof secured to said pulley and the other end portion thereof secured to said plurality of trays, means for rotating said pulley in one direction to move said trays in an upwardly direction and rotating said pulley in the opposite direction to move said trays in a downwardly direction, means, coupled to said pulley, for counter balancing the weight of said trays, and a cam member adapted to rotate said pulley through a predetermined path of rotation.

2. An apparatus for sorting sheets into sets of sheets and positioning the sets of sheets at a set discharge region, including:

at least one vertically oriented rod;

a plurality of trays mounted slidably on said rod, said trays being fixed relative to one another with each one of said trays having an entrance region for receiving sheets and an exit region opposed therefrom; and means for moving successive ones of said trays to the set discharge region so as to remove successive sets of copy sheets from the exit region of said trays, said moving means comprising a pulley, at least one flexible member having one end portion thereof secured to said pulley and the other end portion thereof secured to said plurality of trays, means for rotating said pulley in one direction to move said trays in an upwardly direction and rotating said pulley in the opposite direction to move said trays in a downwardly direction, means, coupled to said pulley, for counter balancing the weight of said trays, a cam member adapted to rotate said pulley through a predetermined path of rotation, and a plurality of followers mounted on said pulley and meshing with said cam member so that rotation of said cam member rotates said pulley through the predetermined path of rotation.

3. An apparatus according to claim 2, wherein said counter balancing means includes spring means for applying a substantially constant torque on said pulley having a magnitude equal to the magnitude of that applied on said pulley by the weight of said trays with the torque applied on said pulley by said spring means being in the opposite direction to the torque applied on said pulley by the weight of said trays.

4. A printing system, including:

means for reproducing copies of original documents on copy sheets; and means, positioned to receive the copy sheets from said reproducing means at a sheet inlet region, for sorting sheets into sets of sheets and positioning the sets of sheets at a set discharge region, comprising at least one vertically oriented rod a plurality of trays mounted slidably on said rod, said trays being fixed relative to one another with each one of said trays having an entrance region for receiving sheets and an exit region opposed therefrom, and means for moving successive ones of said trays to the set discharge region so as to remove successive sets of copy sheets from the exit region of said trays, said moving means comprising a pulley, at least one flexible member having one end portion thereof secured to said pulley and the other end portion thereof secured to said plurality of trays, means for rotating said pulley in one direction to move said trays, means for rotating said pulley in one direction to move said trays in an upwardly direction and rotating said pulley in the opposite direction to move said trays in a downwardly direction, means, coupled to said pulley, for counter balancing the weight of said trays, and a cam member adapted to rotate said pulley through a predetermined path of rotation.

5. A printing system, including:

means for reproducing copies of original documents on copy sheets; and means, positioned to receive the copy sheets from said reproducing means at a sheet inlet region, for sorting sheets into sets of sheets and positioning the sets of sheets at a set discharge region, comprising at least one vertically oriented rod, a plurality of trays mounted slidably on said rod, said trays being fixed relative to one another with each one of said trays having an entrance region for receiving sheets and an exit region opposed therefrom, and means for moving successive ones of said trays to the set discharge region so as to remove successive sets of copy sheets from the exit region of said trays, said moving means comprising a pulley, at least one flexible member having one end portion thereof secured to said pulley and the other end portion thereof secured to said plurality of trays, means for rotating said pulley in one direction to move said trays in an upwardly direction and rotating said pulley in the opposite direction to move said trays in a downwardly direction, means, coupled to said pulley, for counter balancing the weight of said trays, a cam member adapted to rotate said pulley through a predetermined path of rotation, a plurality of followers mounted on said pulley and meshing with said cam member so that rotation of said cam member rotates said pulley through the predetermined path of rotation.

6. A printing machine according to claim 5, wherein said counter balancing means includes spring means for applying a substantially constant torque on said pulley having a magnitude equal to the magnitude of that applied on said pulley by the weight of said trays with the torque applied on said pulley by said spring means being in the opposite direction to the torque applied on said pulley by the weight of said trays.

* * * * *